US005390500A

United States Patent [19]

White et al.

[11] Patent Number: 5,390,500

[45] Date of Patent: Feb. 21, 1995

[54] CRYOGENIC FLUID VAPORIZER SYSTEM AND PROCESS

[75] Inventors: Norman H. White, East Aurora; Boris Pevzner, Williamsville; Thomas D. High, Grand Island, all of N.Y.

[73] Assignee: Praxair Technology, Inc., Danbury, Conn.

[21] Appl. No.: 998,081

[22] Filed: Dec. 29, 1992

[51] Int. Cl.[6] ..... F17C 9/02

[52] U.S. Cl. ..... 62/50.2; 62/48.1; 165/142

[58] Field of Search ..... 62/50.2, 48.1; 165/142

[56] References Cited

U.S. PATENT DOCUMENTS

| | | | |
|---|---|---|---|
| 2,273,257 | 2/1942 | Gardener . | |
| 2,328,647 | 9/1943 | Jackson | 62/50.2 |
| 2,378,077 | 6/1945 | Garretson | 62/50.2 |
| 2,981,278 | 4/1961 | Bergson | 62/50.2 X |
| 3,450,197 | 6/1969 | Fieni | 165/142 |
| 3,672,446 | 6/1972 | Tibbets et al. | 165/183 |
| 3,827,246 | 8/1974 | Moen et al. | 62/50.2 X |
| 4,083,707 | 4/1978 | Bivins | 62/51 |
| 4,233,812 | 11/1980 | Leistritz | 165/142 X |
| 4,296,539 | 10/1981 | Asami | 62/50.2 X |
| 4,317,269 | 3/1982 | Martin et al. | 62/50.2 X |
| 4,343,156 | 8/1982 | Gauthier | 62/50.2 |
| 4,395,976 | 8/1983 | de Lallée et al. | 62/50.2 X |
| 4,399,660 | 8/1983 | Vogler et al. | 62/52 |
| 4,479,359 | 10/1984 | Pelloux-Gervais | 62/52 |
| 4,487,256 | 12/1984 | Lutjens et al. | 165/76 |
| 4,566,284 | 1/1986 | Werley | 62/52 |
| 4,598,554 | 7/1986 | Bastian | 62/51 |
| 5,163,303 | 11/1992 | Miyata et al. | 62/50.2 |

FOREIGN PATENT DOCUMENTS

| | | | |
|---|---|---|---|
| 0450906 | 10/1991 | European Pat. Off. | 62/50.2 |
| 0038943 | 10/1977 | Japan | 62/50.2 |
| 0032855 | 3/1979 | Japan | 62/50.2 |
| 0030585 | 3/1981 | Japan | 62/50.2 |
| 0931466 | 7/1963 | United Kingdom | 62/50.2 |
| 0832240 | 5/1981 | U.S.S.R. | 62/50.2 |

OTHER PUBLICATIONS

Sales Bulletin D3.7.1 of Thermax Corporation. No Date.

Sales Bulletin D8-7 of Thermax Corporation. No Date.

"Bayonet Exchangers", pp. 738-745, of *Process Heat Transfer* by Ronald Q. Kern, May 1950.

*Primary Examiner*—Henry A. Bennet
*Assistant Examiner*—Christopher B. Kilner
*Attorney, Agent, or Firm*—Chung K. Pak; Peter Kent

[57] ABSTRACT

A cryogenic liquid vaporizer system 10 comprising an outer tube 22 for exposure to the atmosphere and enclosing an inner tube 16 to form an annulus 36. The fluid enters the inner tube 16 as liquid, flows in the inner tube 16 where it is at least partially vaporized, and discharges into the outer tube 22. In one embodiment the fluid discharges near the end 34 of the outer tube 22 and counterflow in the annulus 36 where it is usually completely vaporized and partially superheated. In another embodiment, the fluid discharges into the outer tube 22 and continues to flow in the longitudinal space 38 provided by the length of outer tube 22. The annulus 36 is occupied by quiescent fluid.

15 Claims, 4 Drawing Sheets

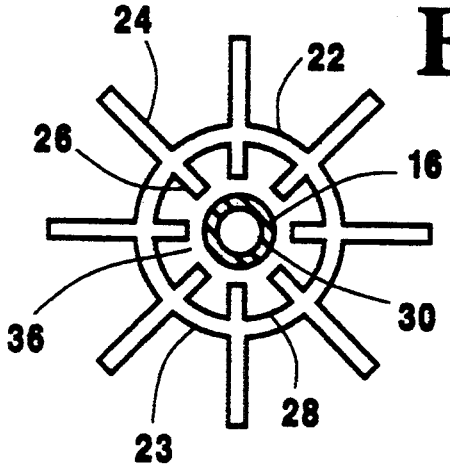
Fig. 2
Fig. 4
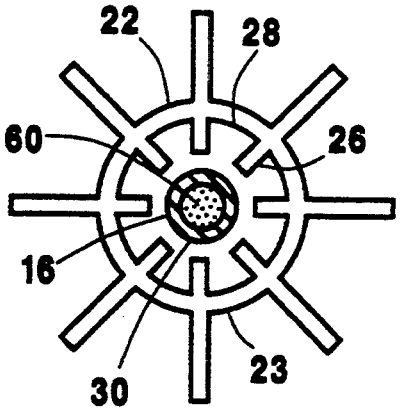
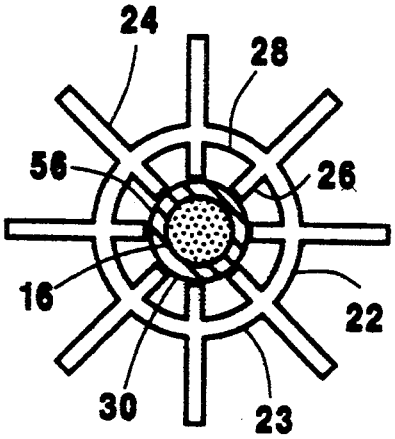
Fig. 5
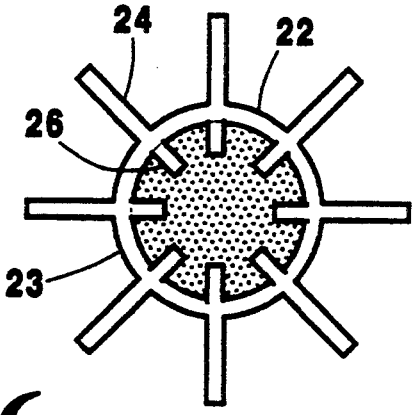
Fig. 6

Fig. 7
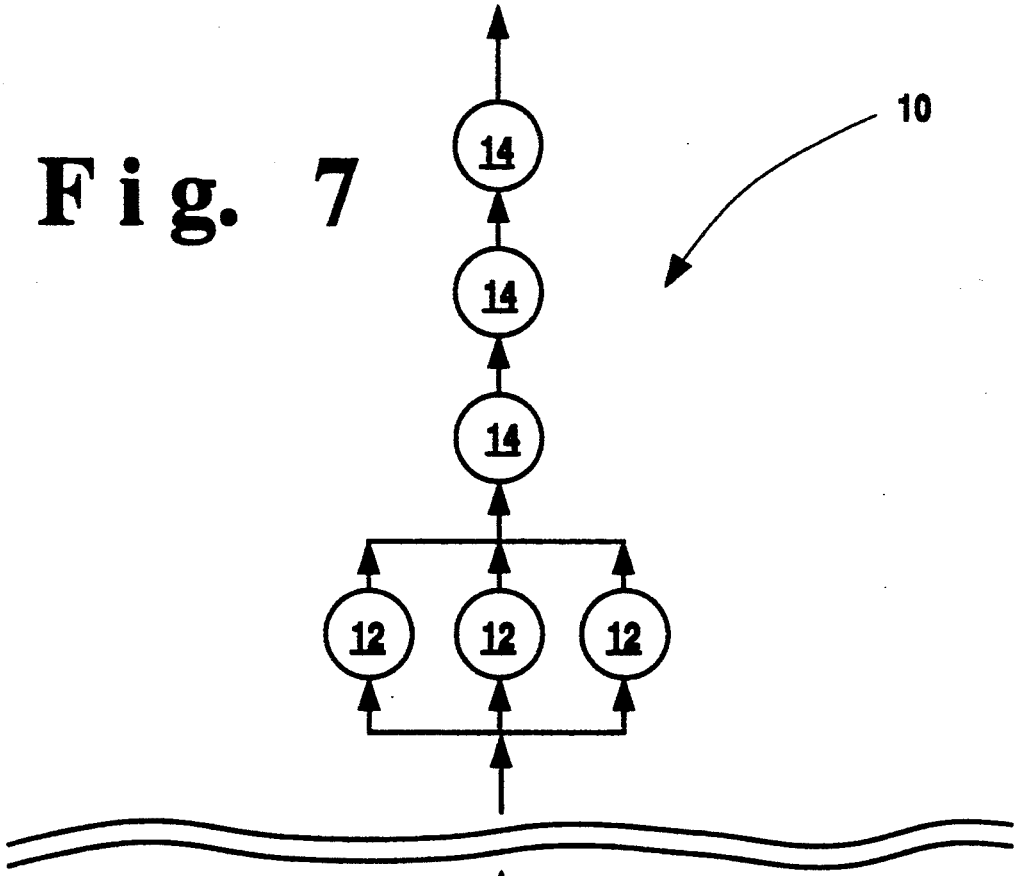
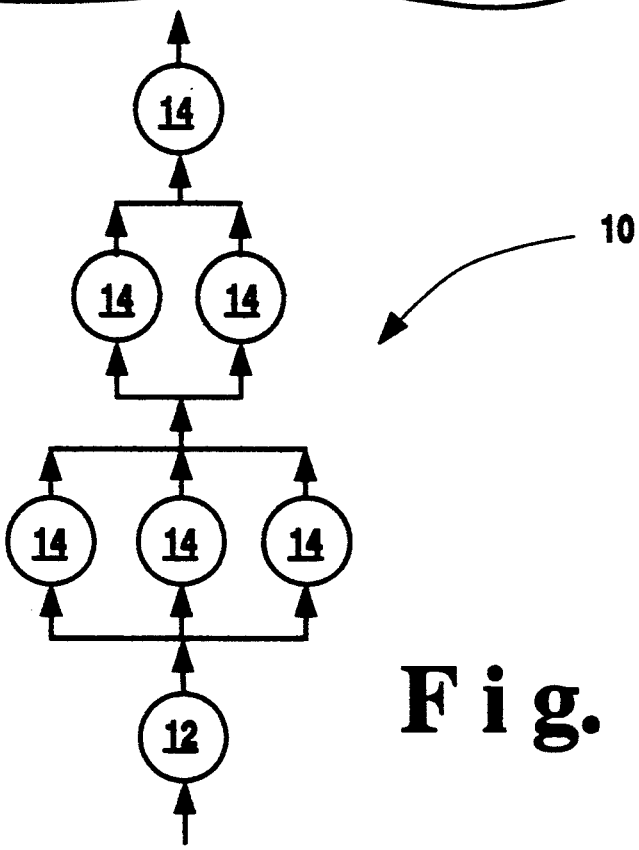
Fig. 8

CRYOGENIC FLUID VAPORIZER SYSTEM AND PROCESS

BACKGROUND OF THE INVENTION

This invention relates to cryogenic fluid vaporizers and particularly to vaporizers heated by exposure to ambient atmosphere.

Atmospheric gases produced by separation of air, such as oxygen, nitrogen and argon, find wide use in a variety of industrial applications. Large quantity users of such a gas, such as steel mills or aluminum remelters, may have air separation plants installed at the usage site. Small quantity users of such gases typically purchase the quantities required in high pressure cylinders. Intermediate quantity users of such a gas typically find it convenient to purchase a supply of the gas in liquid form, that is, as a cryogenic liquid, maintain it in a storage tank at the usage site and vaporize the cryogenic liquid from the tank as needed in a vaporizer. Cryogenic liquid as used herein is defined to mean a liquid boiling at temperatures below 200K.

A user may require intermittent or continuous flow of gas to be generated from a cryogenic liquid stored in a tank. To produce a continuous flow of gas by vaporizing liquid, a heat exchanger may be used with heat supplied by a hot fluid, such as steam generated in another process. Alternately, an electrical heater may be employed. However, the most common source of heat for continuous and intermittent cryogenic liquid vaporization is the ambient atmosphere.

An atmospheric vaporizer system is typically comprised of one or more passes of tubes or modules vertically positioned. The exterior of the tubes is exposed to the ambient atmosphere and may have extended surface. The cryogenic liquid is caused to flow in the interior of the tube where it is vaporized and is superheated as required—perhaps even to approach the ambient atmospheric temperature.

As the cryogenic liquid passes through the atmospheric vaporizer system, the exterior surfaces of the vaporizer system are cooled. The exterior surfaces of a conventional ambient vaporizer system typically range from temperatures approaching the boiling temperature of the cryogenic fluid, such as 77K for nitrogen to temperatures approaching the ambient air temperature. The cold exterior surfaces of the vaporizer system cool the surrounding air. When the temperature of the surrounding air is cooled below its dew point, a film of water is deposited on the exterior surfaces of the vaporizer system and a mist of condensed water, that is, fog, is formed in the air. On the portion of the exterior surface which is below the freezing point of water, the water freezes and ice builds up over time. The ice build up may completely fill the space between adjacent fins on the exterior of the vaporizer tubes, and, in time, may even fill the space between adjacent tubes. Ice build up presents several problems. It reduces the surface area of the vaporizer and acts as an insulation. Both effects decrease the rate of heat transfer from the ambient atmosphere to the exterior surfaces of the vaporizer and thus the capacity of the vaporizer. The ice may build up to a weight ten or more times greater than the weight of the vaporizer itself. The structure of the ice is not uniform, nor predictable. Portions of ice may spall off intermittently during operation, or during deicing maneuvers, presenting a hazard to the vaporizer itself, associated piping and attendant personnel. Furthermore, the fog generated in the vicinity presents a hazard to vehicular and pedestrian traffic due to reduced visibility.

Management of the problem of ice build up has been attempted in several ways. Periodic manual deicing is performed by personnel by applying external hot water jets or steam jets, and by mechanical removal using picks and shovels. The practice is undesirable in that manual action is required. The ice structure is unpredictable. Falling ice may injure personnel performing the work and may structurally damage the vaporizer and associated piping. Fog generation is not reduced by such manual, periodic deicing.

A management technique is to accommodate ice build up on an initial length of bare piping, that is, piping without external finning. The bare piping is then followed in series by piping with external finning. The bare piping is intended to provide most or all of the surface for ice deposit. The logic is that the bare piping is less costly than the finned piping and can be supported in a less costly array to accommodate high ice build up. However, an undesirably large amount of bare piping, floor space, and structural support needs to be used, making this approach unattractive. Fog generation also remains a problem and is not reduced by this technique.

Another approach has been to provide one or more duplicate banks of vaporizers. While one bank is in active service, one or more other banks may be defrosting. A number of schemes may be used for switching banks. A simple scheme is to switch banks purely on a time schedule thereby disregarding other considerations. This approach uses redundant vaporizers which are expensive and also increase space requirements. Fog generation, however, remains a problem and is not reduced by this technique.

Yet another approach has been to oversize the vaporizer system resulting in reduced average heat transfer loading per vaporizer module, thereby increasing the cost and floor space requirement. Fog generation usually is reduced somewhat by this technique.

For the foregoing reasons, there has been a need for a vaporizer system for cryogenic liquids which eliminates or reduces icing of the exterior surfaces of the vaporizer which are exposed to the ambient atmosphere, and reduces fog generation without requiring excessive redundant vaporizer surface area or vaporizer structure.

SUMMARY OF THE INVENTION

The present invention is directed to a process for controlling the vaporization of cryogenic liquid by heat from the ambient atmosphere so as to reduce icing of the outer surfaces of the vaporizer and to reduce the generation of fog in the atmosphere. The process comprises:

(a) providing an outer tube enveloping an inner tube;
(b) exposing the exterior surface of the outer tube to the ambient atmosphere;
(c) passing cryogenic liquid into said inner tube;
(d) vaporizing at least a portion of the cryogenic liquid in the inner tube;
(e) discharging the resulting liquid and vapor from the inner tube into the outer tube;
(f) forming a layer of the vapor in the annular space between the inner tube and the outer tube to provide a controlling thermal resistance;

(g) transferring heat from the ambient atmosphere through the outer tube, through the layer of the vapor in the annular space, through the inner tube and into the cryogenic liquid flowing in the inner tube, so as to vaporize cryogenic liquid in the inner tube and heat the resulting vapor in the annular space at a controlled rate such that of the design conditions along a substantial length of the outer tube the temperature gradient is moderate and the temperature is above the freezing temperature of water.

In one embodiment of the invention, step (d) is accomplished by causing the liquid and vapor after discharge from the inner tube to pass through the annulus in counterflow relative to the cryogenic liquid in the inner tube, whereby heat from the atmosphere is transferred through the vapor flowing in the annulus to the cryogenic liquid in the inner tube. In another embodiment, step (d) is accomplished by occupying the annular space between the inner tube and the outer tube with vapor discharged from the inner tube thereby interposing a high thermal resistance between the inner surface of the outer tube and the outer surface of the inner tube. In this embodiment, the process further comprises passing the liquid and vapor discharged from said inner tube through a length of said outer tube unoccupied by said inner tube.

Another embodiment of the invention is directed to a vaporizer system that satisfies these needs. A vaporizer having features of the invention comprises an evaporator module having an inner tube within an outer tube. The inner tube has an entry end for entry of the cryogenic liquid and a discharge end for discharge of the resulting liquid and vapor. The outer tube has a finned exterior surface for exposure to ambient atmosphere; a first end sealed to the outer cross section of the inner tube at the entry end of the inner tube; a second end remote from the first end of the outer tube; and an interior cross section larger than the outer cross section of the inner tube. The outer tube has a length enveloping the inner tube from the entry end of the inner tube beyond the discharge end of the inner tube, thereby forming an annular space between the inner tube and the outer tube and a longitudinal space between the discharge end of the inner tube and the second end of the outer tube. The inner tube discharge end extends proximately to, but short of the second end of the outer tube, which is closed to fluid flow. The outer tube has an exit proximate to the first end of the outer tube.

In another embodiment, the inner tube discharge end extends substantially short of the second end of the outer tube. Proximate to the second end of the outer tube is an exit for fluid flow.

A feature of the vaporizer is that its exterior surface under average product delivery and average atmospheric conditions, has a moderate longitudinal temperature gradient and temperatures that are somewhat above the freezing point of water. The heat load is distributed more uniformly along the length by a resistance to heat transfer between the surface confining the initial pass of cryogenic liquid in the vaporizer and the exterior surface of the vaporizer, that is, between the interior surface of the outer tube and the exterior surface of the inner tube. The resistance is provided in the embodiment first described by a flowing layer of vapor in the annular space, and in the embodiment secondly described by a quiescent layer of vapor in the annular space. The advantages provided by these features include elimination of icing under design conditions, and reduced icing under more severe conditions. Another advantage is greatly reduced fog generation under all conditions.

BRIEF DESCRIPTION OF THE DRAWINGS

These and other features and advantages of the invention will be apparent from the following description taken in conjunction with the accompanying drawings wherein:

FIG. 2 is a transverse section taken along the line 2—2 of FIG. 1.

FIG. 4 is a transverse section taken along the line 4—4 of FIG. 3.

FIG. 5 is a transverse section taken along the line 5—5 of FIG. 3.

FIG. 6 is a transverse section taken along the line 6—6 of FIG. 3.

FIG. 7 is a schematic arrangement of evaporator and heater modules shown in FIG. 1 through FIG. 6.

FIG. 8 is another schematic arrangement of evaporator and heater modules shown in FIG. 1 through FIG. 6.

DETAILED DESCRIPTION OF THE INVENTION

Figure 1:
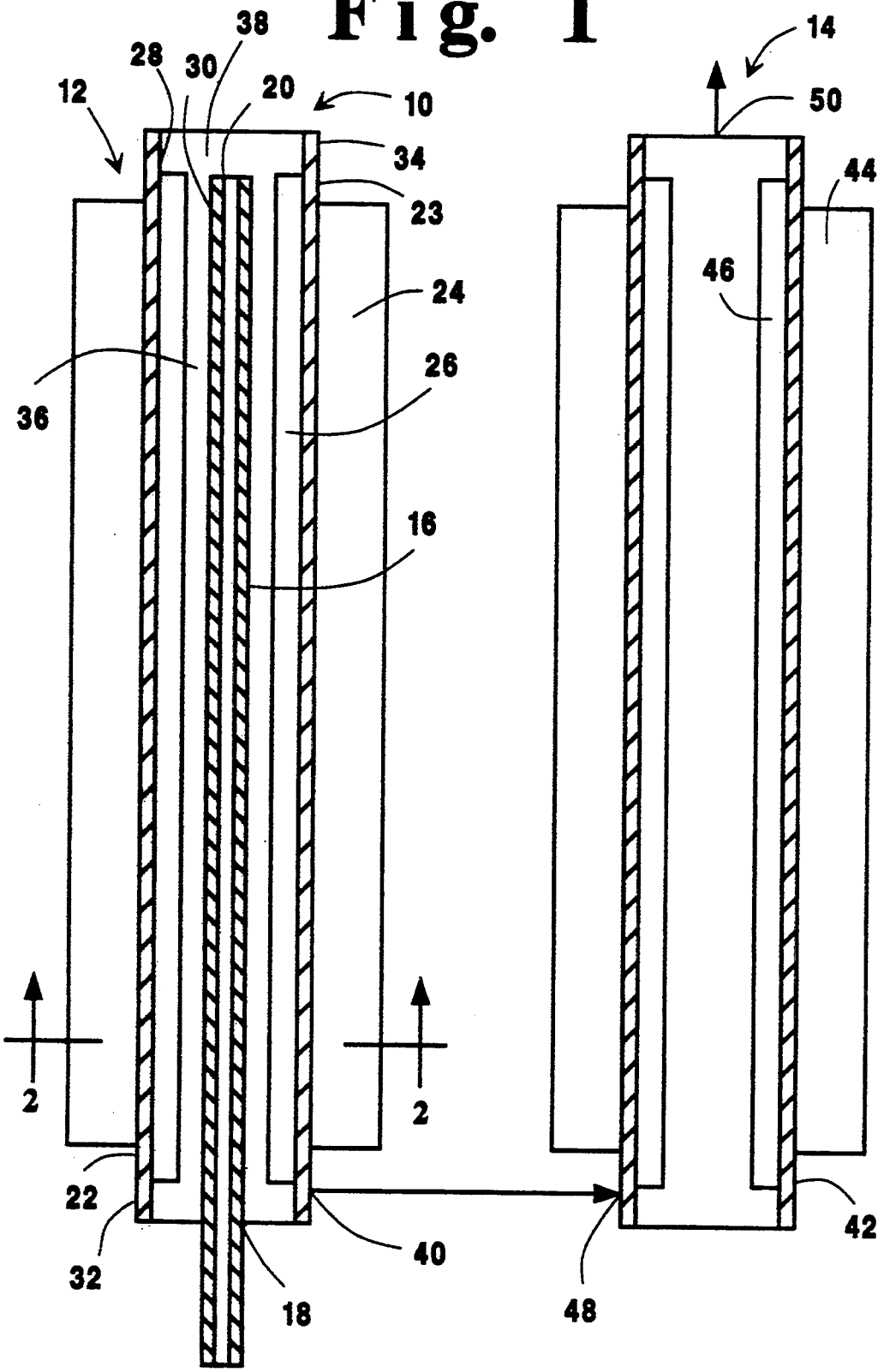
FIG. 1 is a side elevation, partly in section and partly in schematic, of one embodiment of the vaporizer.

In an exemplary embodiment of the invention disclosed in FIG. 1 and FIG. 2, an evaporator 10 comprises an evaporator module 12 and a heater module 14. An evaporator module comprises an inner tube 16 having an entry end 18 for entry of cryogenic fluid, substantially as liquid, and a discharge end 20 for discharge of the resulting cryogenic fluid. The discharge end 20 of the inner tube 16 discharges into the interior of an outer tube 22 which envelops the inner tube 16. The outer tube 22 may have a simple, unextended exterior surface 23 for exposure to the ambient atmosphere, but more typically, a finned exterior surface 24 for increased exposure of heat transfer surface to the ambient atmosphere. The outer tube 22 may also have a finned interior surface 26. The interior cross section 28 of the outer tube is larger than the outer cross section 30 of the inner tube to accommodate the inner tube. The outer tube 22 has a first end 32 which is sealed to the outer cross section 30 of the inner tube 16 at the entry end 18 of the inner tube and a second end 34 remote from the first end 32. The second end 34 of the outer tube is closed to fluid flow. The length of the outer tube 22 envelopes the inner tube 16 from the entry end 18 of the inner tube 16 to beyond the discharge end 20 of the inner tube 16, thereby forming an annular space 36 between the inner tube 16 and the outer tube 22 and a longitudinal space 38 between the discharge end 20 of the inner tube 16 and the second end 34 of the outer tube 22.

The inner tube discharge end 20 extends proximately to but short of the second end 34 of the outer tube 22. The outer tube 22 has an exit 40 for fluid flow proximate to the first end 32 of the outer tube 22. The outer tube 22 is preferably oriented with the first end 32 of the outer tube below the second end 34. Most preferably the outer tube is oriented vertically.

A heater module 14 comprises a tube 42 typically having a finned exterior surface 44, optionally a finned interior surface 46, an entrance 48 for fluid flow at one end and an exit 50 for fluid flow at the other end. Preferably a heater module 14 is vertically oriented and the entrance 48 for fluid flow to the module may be at the upper end or the lower end of the tube 42. The exit of an evaporator module 12 (which is in effect the exit 40 of the outer tube 22 in the evaporator module) is connected with the entrance 48 of a heater module 14.

Arrangements which may be efficient for particular sets of operating conditions are a bank of from two to four paralleled evaporator modules 12 discharging to one or more serially connected banks of one or more paralleled heater modules 14 as depicted in FIG. 7. A preferred arrangement, as depicted in FIG. 8, is one or more evaporator modules connected in parallel serially followed by a bank having a first number of two or more paralleled heater modules, serially followed by at least another bank having a second number of paralleled heater modules, wherein the second number is smaller than the first number. In such an arrangement, a number of paralleled evaporator modules comprising a bank of evaporator modules cooperate with a number of heater modules. The heater modules are arranged in a number of banks of paralleled modules and the heater banks are connected successively in series. The number of paralleled heater modules in a bank decrease in successive banks so that the mass velocity of the fluid flowing in successive banks of heater modules increases, thereby decreasing the film resistance to heat transfer at the inside surface of the tubes comprising the heater modules. In this way the exterior surface of the heater modules is kept more uniform in temperature, and usually above the freezing temperature of water, thereby reducing or eliminating the tendency to form ice on the heater module outer surfaces and fog in the atmosphere.

In another exemplary embodiment of the invention disclosed in FIGS. 3 to 6, a vaporizer 10 comprises an evaporator module 12 and a heater module 14 as previously described. However in this subsequent embodiment, the discharge end 20 of the inner tube 16 is usually substantially short of the second end 34 of the outer tube 22 to provide surface for heat transfer after fluid emerges from the discharge end 20 of the inner tube 16. Typically the inner tube 16 extends two-thirds of the length of the outer tube 22. The outer tube 22 has an exit 52 for fluid flow at the second end 34 of the outer tube. Preferably the inner tube 16, for a length 54 adjoining its discharge end 20 has a larger outer cross section 56 than a length 58 adjoining its entry end 18 which has a smaller cross section 60. A typical configuration is for the outer tube 22 to have one third of its length internally occupied by a length of inner tube 58 of small outer cross section 60, a second third of its length internally occupied by a length of inner tube 54 of larger outer cross section 56, and another third of its length internally unoccupied.

Optionally, the inner tube 16 proximate its entry end 18 has a bleed hole 62 leading from its internal cross section to the annular space 36 between the inner tube and the outer tube. Optionally, the annular space 36 between the inner tube and the outer tube may be occupied in part or in total by a solid material, preferably a heat insulative material, and most preferably fiberglass or a foamed insulative material.

In this subsequent embodiment, a heater module 14 is similar to that in the embodiment previously described, and the exit of an evaporator module 12 (which is in effect the exit 52 of the outer tube 22) is connected with the entrance 49 of a heater module 14. Additional heater modules may be connected in parallel and in series. Arrangements may be made as narrated with respect to the embodiment first described.

In the exemplary embodiment of the invention first described and disclosed in FIG. 1 and FIG. 2, cryogenic fluid, typically mostly or all liquid, enters the entry end 18 of the inner tube 16. As it passes upwards through the inner tube 16, it boils with very little film resistance to heat transfer at the inner surface of the inner tube. Mild operational conditions for the evaporator occur with below average cryogenic fluid flow rate and with warm ambient atmospheric conditions. Under mild conditions, the flow discharges from the inner tube as vapor. In flowing through the annular space, the vapor is further warmed and becomes superheated. The vapor flow provides a high film resistance at the interior wall of the outer tube 22 and the outer wall of the inner tube 16 and a high thermal resistance across the annular space 36. Thus the overall resistance from the inner wall of the outer tube 22 to the fluid in the inner tube 16 is high and controlling, thereby reducing the cooling rate of the outer surfaces 23, 24 of the outer tube by the cryogenic fluid. Under such mild operational conditions, this allows the outer surfaces 23, 24 to be at temperatures above the freezing temperature of water. The temperature gradient along the length of the outer surface of the outer tube is also considerably reduced and is moderate. With the preferred vertical orientation of the evaporator module 12, the coldest temperature in the outer surface of the outer tube 22 occurs at the second end 34 or top of the outer tube where heating by the atmosphere most readily occurs. Thus ice does not form nor accumulate, and fog generation is reduced or eliminated.

The design conditions for the vaporizer 10 are average cryogenic fluid flow rate through the vaporizer and average ambient atmospheric conditions. Under such average operational conditions, the flow discharges from the inner tube 16 into the end of the outer tube 22 approximately as a saturated vapor, or as a mixture of vapor and liquid. The fluid then flows in the annulus 36 between the outer tube and the inner tube. In this way, an evaporator module 12 endogenously compensates for more demanding operational conditions. In the annulus, vapor flow provides high film resistances at the interior wall of the outer tube 22 and the outer wall of the inner tube 16, and interposes a high thermal resistance between the walls. Any liquid present in the annular flow usually exists as saturated liquid, and mostly flows in the annulus. However any liquid contacting the interior wall of the outer tube 22 forms a film which evaporates with high film resistance. Thus the evaporator module 12 has the advantages that the temperature gradient along the length of the outer tube 22 is moderate, and, at the design condition, the temperature of the outer surfaces 23, 24 are above the freezing temperature of water, thereby avoiding ice deposit on the outer surfaces.

On leaving the evaporator module 12, the flow, under the design condition, is vapor and somewhat superheated. On entering the heater module 14, the flow is further superheated. Since the flow is vapor in the tube 42 and high film resistance occurs at the inner surface of the tube 42, and since the temperature of the vapor is then somewhat warmer than the boiling temperature of the fluid, the outer surface of the tube 42 is above the freezing temperature of water and remains ice free.

Severe operational conditions for the vaporizer occur with abnormally high throughputs of cryogenic liquid, or abnormally cold ambient atmospheric conditions. During such severe operational conditions, the fluid discharges from the inner tube 16 into the end of the outer tube 22 only partially vaporized, that is, as vapor and liquid. The liquid does not completely vaporize as the fluid flows through the annular space 36. With the preferred vertical orientation of an evaporator module 12, a pool of liquid forms in the bottom of the outer tube 22. Pool boiling with very low thermal resistance then occurs at the inner surface of the outer tube 22, thus allowing the evaporator module 12 to adjust to compensate for the severe operational condition. Liquid also may flow from the evaporator module 12 to the heater module 14 where its evaporation is completed. Under such severe conditions, some ice may form on the exterior surface of the outer tube 22 of the evaporator module, and is usually tolerable for the limited duration of such conditions.

Figure 3:
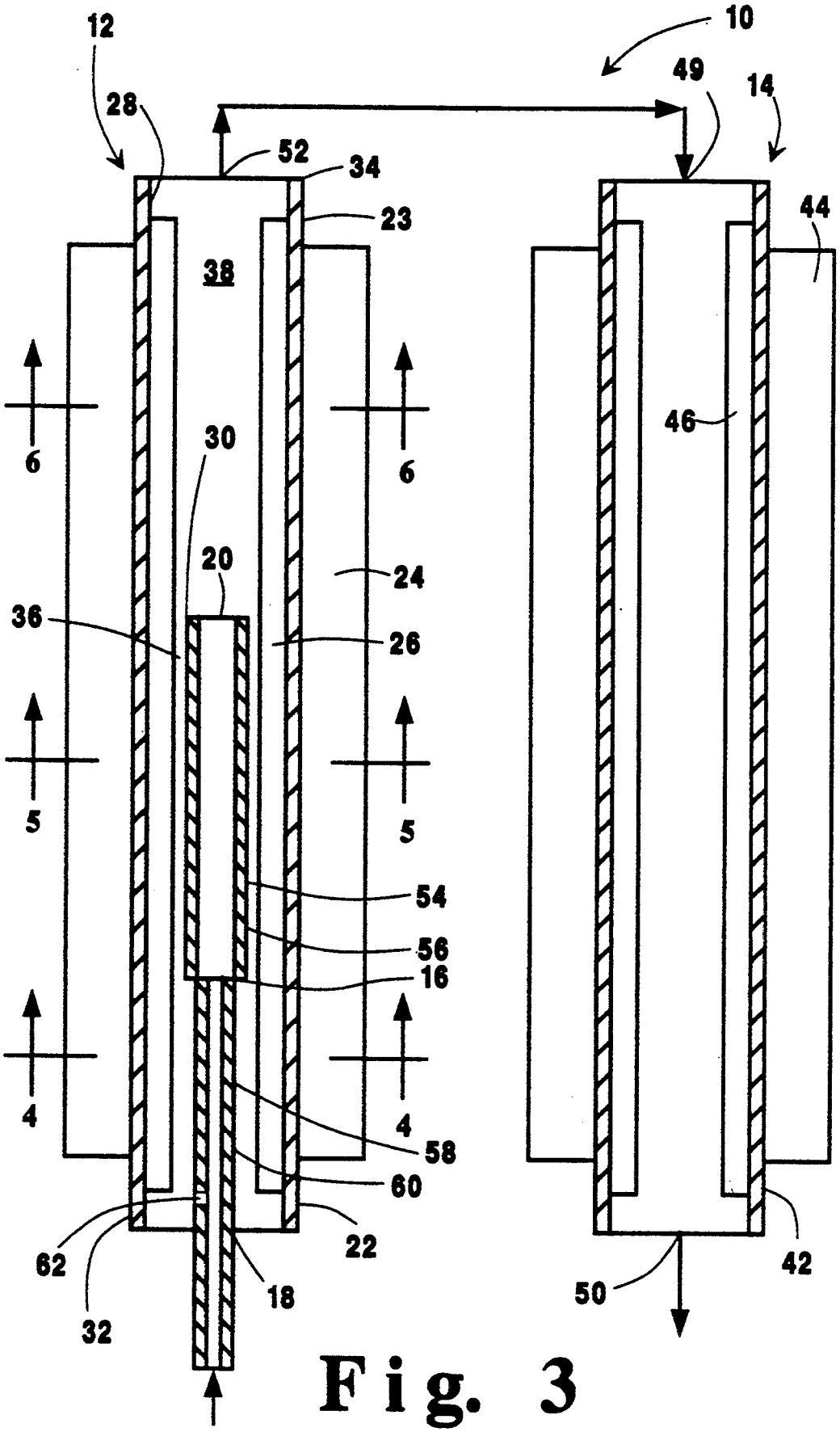
FIG. 3 is a side elevation, partly in section and partly in schematic, of another embodiment of the vaporizer.

In the exemplary embodiment of the invention secondly discussed and disclosed in FIG. 3, cryogenic fluid, typically mostly or all liquid, enters the entry end 18 of the inner tube 16 in the A-unit 12. In the preferred vertical orientation of the evaporator module 12, fluid passing upwards through the inner tube 16, boils with very little thermal resistance to heat transfer at the inner surface of the inner tube. Under mild operating conditions and under the design operating condition, the flow discharges from the inner tube as vapor. In flowing through the remaining length of the outer tube 22, the vapor is further warmed and becomes superheated.

Under mild operating conditions, the annular space 36 between the inner tube and the outer tube is occupied by quiescent vapor, which provides a very high film resistance to heat transfer at the interior wall of the outer tube 22 and the exterior wall of the inner tube 16, and also a high thermal resistance to heat transfer across the annulus 36. Thus the overall resistance from the inner wall of the outer tube 22 to the fluid in the inner tube 16 is high and controlling, thereby allowing only a moderate cooling rate of the outer surface of the outer tube 22 by the cryogenic fluid, and allowing the outer surface to be at relatively high temperature, albeit below the ambient atmospheric temperature. The temperature gradient along the length of the outer surface of the outer tube 22 is considerably reduced and is moderate. These effects eliminate ice accumulation from the ambient atmosphere on the exterior surface of the outer tube. A purge flow through the annular space 36 may be provided with one or more small bleed holes 62 through the inner tube 16 near its entry end 18. The purge flow does not substantially attenuate the overall thermal resistance from the inner wall of the outer tube 22 to the fluid in the inner tube 16.

Under the design condition and even operational conditions somewhat more harsh than the design condition, the flow discharges from the inner tube 16 into the outer tube 22 approximately as a saturated vapor, or as a mixture of vapor and saturated liquid. Some of the liquid may separate from the vapor and trickle downwards into the annulus 36. Saturated liquid contacting the interior surface of the outer tube 22 forms a film which presents a high thermal resistance, but is evaporated before reaching the bottom of the outer tube 22. This evaporation lowers the temperature of the exterior surface of the outer tube 22 somewhat, but allows a larger heat flux to occur. In this way, the vaporizer autogenously compensates for the higher thermal loading.

On leaving the evaporator module 12, the flow, under the design condition, is vapor, and on entering the heater module 14, is heated. The vapor flow in the tube 42 produces a high film resistance at the inner surface of the tube 42, and with the temperature of the vapor then somewhat warmer than the boiling temperature of the fluid, the outer surface of the tube 42 is above the freezing temperature of water and remains ice free.

During severe operational conditions, the fluid discharges from the inner tube 16 into the outer tube 22 only partially vaporized, that is, as vapor and liquid. With the preferred vertical orientation of an evaporator module 12, liquid separates from the vapor and flows downward in the annular space 36 to form a pool of liquid in the bottom of the outer tube 22. Pool boiling then occurs at the inner surface of the outer tube 22, with very low thermal resistance, thus allowing the evaporator module 12 to adjust to compensate for the severe operational condition. Liquid also may flow from the evaporator module 12 to the heater module 14 where its evaporation is completed. Under severe conditions, some ice forms on the exterior surface of the outer tube 22 in the evaporator module 12, but usually tolerable for the limited duration of such conditions.

Thus this invention provides a vaporizer which operates at more uniform and higher exterior surfaces temperatures than prior art evaporators. It provides many advantages including no icing and no fog generation at the design condition which corresponds to average operating conditions. Under more severe operating conditions, the vaporizer provides reduced icing of exterior surfaces and reduced fog generation compared to prior art vaporizers. Additional advantages are that the vaporizer does not have multiple duplicate banks nor uneconomic and redundant surface area and floor space. Deicing operations are eliminated under most circumstances.

Although certain preferred embodiments of the present invention have been described by way of illustration, the spirit and scope of the invention is by no means intended to be restricted to what has been described.

What is claimed is:

1. A process for controlling the vaporization of cryogenic liquid using heat from ambient atmosphere, said process comprising:

(a) providing an outer tube enveloping an inner tube;
(b) exposing an exterior surface of said outer tube to the ambient atmosphere;
(c) passing cryogenic liquid into said inner tube;
(d) vaporizing at least a portion of the cryogenic liquid in said inner tube to form liquid and vapor;
(e) discharging the resulting liquid and vapor from said inner tube directly into an annular space between said inner tube and said outer tube;
(f) forming a layer of the vapor in the annular space between said inner tube and said outer tube to provide a controlling thermal resistance;
(g) transferring heat from the ambient atmosphere through said outer tube, through the layer of the vapor in the annular space, through said inner tube and into the cryogenic liquid flowing in said inner tube, so as to vaporize cryogenic liquid in said inner tube and heat the resulting vapor in the annular space.

2. The process as in claim 1 wherein step (g) is carried out at a controlled rate such that along a substantial length of said outer tube the temperature gradient is moderate and the temperature is above the freezing temperature of water.

3. The process as in claim 1, further comprising passing the liquid and vapor discharged from said inner tube through a length of said outer tube unoccupied by said inner tube.

4. A cryogenic liquid vaporizer system capable of being heated by ambient atmosphere, said vaporizer system comprising at least one evaporator module comprising:

(a) an inner tube having:
  (1) an entry end for entry of cryogenic liquid; and
  (2) a discharge end for discharge of vaporized and unvaporized cryogenic liquid;

(b) an outer tube having:
  (1) a finned exterior surface means for exposure to ambient atmosphere;
  (2) a finned interior surface at least substantially facing an exterior surface of said inner tube;
  (3) an interior cross section larger than an outer cross section of said inner tube;
  (4) a first end sealed to the outer cross section of said inner tube at said entry end of said inner tube;
  (5) a second end remote from said first end; and
  (6) a length enveloping said inner tube from said entry end of said inner tube beyond said discharge end of said inner tube thereby forming an annular space between said inner tube and said outer tube and a longitudinal space between the discharge end of said inner tube and the second end of said outer tube.

5. The vaporizer system as in claim 4 wherein said inner tube discharge end extends proximately to but short of said second end of said outer tube, said second end is closed to fluid flow and said outer tube has an exit proximate to said first end of said outer tube.

6. The vaporizer system as in claim 4 wherein said first end of said outer tube is lower than said second end of said outer tube.

7. The vaporizer system as in claim 5 further comprising at least one heater module comprising a pipe having an entrance for fluid flow at one end and an exit for fluid flow at the other end, said entrance of said heater module connected with said exit of said evaporator module.

8. A cryogenic liquid vaporizer system comprising at least one source containing cryogenic liquid, at least one evaporator module and at least one heater module, each capable of being heated by ambient atmosphere, said at least one evaporator module comprising: an inner tube having an entry end in fluid communication with said at least one source containing cryogenic liquid and a discharge end for discharge of vaporized and unvaporized cryogenic liquid, and an outer tube having an exterior surface means for exposure to the ambient atmosphere, an interior cross section larger than an outer cross section of said inner tube, a first end sealed to the outer cross section of said inner tube at said entry end of said inner tube, a second end remote from said first end, a length enveloping said inner tube from said entry end of said inner tube beyond said discharge end of said inner tube thereby forming an annular space between said inner tube and said outer tube and a longitudinal space between the discharge end of said inner tube and the second end of said outer tube, and an exit for fluid flow; and at least one heater module comprising: a pipe having an entrance flow at one end and an exit for fluid flow at the other end, wherein said entrance of said heater module connected with said exit of said evaporator module.

9. The vaporizer system as in claim 8, wherein said heater module pipe is externally and internally finned.

10. The vaporizer system as in claim 8 wherein said at least one evaporator module comprises at least two evaporator modules connected in parallel.

11. The vaporizer system as in claim 8 wherein said at least one heater module comprises multiple heater modules arranged in serialized banks of paralleled heater modules, where each successive bank has fewer paralleled heater modules than its preceding bank.

12. The vaporizer system as in claim 4 wherein said inner tube discharge end extends substantially short of said second end of said outer tube, and said outer tube has an exit for fluid flow proximate to said second end of said outer tube.

13. The vaporizer system as in claim 12 wherein said inner tube for a length adjoining said discharge end has a larger outer cross section than a length adjoining said inlet end.

14. The vaporizer system as in claim 12 further comprising a solid material for at least a portion of the space between said inner tube and said outer tube, and for at least a portion of the length of said inner tube.

15. A cryogenic liquid vaporizer system comprising at least one evaporator module comprising:

(a) an inner tube having:
  (1) an entry end for entry of cryogenic liquid; and
  (2) a discharge end for discharge of vaporized and unvaporized cryogenic liquid;

(b) an outer tube having:
  (1) an exterior surface means for exposure to ambient atmosphere;
  (2) an interior cross section larger than an outer cross section of said inner tube;
  (3) a first end sealed to the outer cross section of said inner tube at said entry end of said inner tube;
  (4) a second end remote from said first end; and
  (5) a length enveloping said inner tube from said entry end of said inner tube beyond said discharge end of said inner tube thereby forming an annular space between said inner tube and said outer tube and a longitudinal space between the discharge end of said inner tube and the second end of said outer tube, wherein said inner tube proximate its entry end has at least one bleed hole leading to the space between said inner tube and said outer tube.

* * * * *